US005644848A

United States Patent [19]

Totten

[11] Patent Number: 5,644,848

[45] Date of Patent: Jul. 8, 1997

[54] FOLDING SAFETY CAN OPENER AND METHOD FOR OPENING CANS

[76] Inventor: Roger W. Totten, 10372C W. Florida Ave., Lakewood, Colo. 80232

[21] Appl. No.: 492,226

[22] Filed: Jun. 19, 1995

[51] Int. Cl.[6] ..... B67B 7/46

[52] U.S. Cl. ..... 30/450; 30/407; 81/3.55; 7/152

[58] Field of Search ..... 30/407, 409, 435, 30/446, 450, 410, 443, 445; D9/437; D8/18, 41, 43; 81/3.55, 177.6; 7/152

[56] References Cited

U.S. PATENT DOCUMENTS

| | | | |
|---|---|---|---|
| D. 143,241 | 12/1945 | Porter | D22/2 |
| D. 168,053 | 10/1952 | Forte | 30/450 X |
| D. 297,201 | 8/1988 | Allen | D7/99 X |
| 1,191,608 | 7/1916 | Miner . | |
| 1,507,093 | 8/1924 | Schioninger . | |
| 2,188,352 | 1/1940 | Hothersall | 30/450 X |
| 2,257,532 | 1/1941 | Perocco | 30/3 |
| 2,456,257 | 3/1948 | Eckman | 30/450 X |
| 2,598,839 | 6/1952 | Schulz et al. | 30/450 X |
| 2,660,781 | 12/1953 | Harms | 30/446 X |
| 2,677,882 | 5/1954 | Scheringer | 30/10 |
| 2,716,277 | 8/1955 | Riley | 30/450 X |
| 2,733,505 | 6/1956 | Kenington et al. | 30/22 |
| 2,761,210 | 3/1956 | Chun | 30/6.1 |
| 2,851,704 | 9/1958 | Zoeller | 30/450 X |
| 3,027,634 | 4/1962 | Hansen et al. | 30/407 X |
| 5,189,750 | 3/1993 | Brennan | 7/152 |

FOREIGN PATENT DOCUMENTS

| | | | |
|---|---|---|---|
| 446822 | 5/1936 | United Kingdom . | |
| 725975 | 3/1955 | United Kingdom | 30/16 |

*Primary Examiner*—Rinaldi I. Rada
*Assistant Examiner*—Boyer Ashley
*Attorney, Agent, or Firm*—Stephen A. Gratton

[57] ABSTRACT

A folding can opener and an improved method for opening cans are provided. The can opener includes a handle; a cutter pivotably mounted to the handle; and a locking mechanism for the cutter. The cutter can be locked in an operating position in which a pointed tip of the cutter is adapted to pierce the can. The cutter can also be locked in a storage position in which the pointed tip is folded towards the handle and shielded by the handle. The locking mechanism includes a barrel cam formed on the cutter and having a lug for engaging a seam of the can and pairs of indentations having camming edges. The indentations are adapted for mating engagement with pawls formed on the handle (or separate pins placed between the handle and cutter). The handle is formed in a wish bone shape which permits the pawls to flex to allow engagement and disengagement of the pawls with the indentations. The shape of the indentations and camming edges allows the cutter to be locked in the operating or storage positions but rotated by a user between the operating and storage positions.

27 Claims, 10 Drawing Sheets

FOLDING SAFETY CAN OPENER AND METHOD FOR OPENING CANS

FIELD OF THE INVENTION

The present invention relates generally to tools and specifically to can openers for opening metal cans.

BACKGROUND OF THE INVENTION

For over twenty years, beverages such as beer and soft drinks, have been packaged in aluminum cans. Typically, aluminum beverage cans include a tab opener, also known as a convenience opener, which permits a consumer to open the can without a separate can opener. These types of tab openers include a score line formed in the can end and a tab riveted to the can end for breaking open the score line. Although this type of opener is almost universally employed by the beverage industry, there are some problems associated with its use.

One problem is the cost associated with manufacturing cans having a tab opener. The tab openers are complicated mechanisms which require specialized manufacturing processes such as scoring, embossing and riveting. In addition, the tab openers are formed of expensive materials (e.g., aluminum) and require the can end to be formed with a thicker gage of material. Packaging and shipping costs for cans with tab openers are also higher because the tab opener adds volume to the can without increasing its fluid capacity.

Another problem with tab openers is their detrimental effect on the environment. In particular, the tab portion of a tab opener is often broken away from the can by the consumer and is a major source of litter. Additionally, the increased energy, materials and waste associated with the manufacture and shipping of cans with tab openers has an adverse impact on the environment. The tab openers can also be difficult to use and often break the fingernails of the consumer. Furthermore, the scored opening for a tab opener does not pour smoothly, and can make drinking from the can difficult.

Because of these and other problems associated with beverage cans having tab openers, some beverage manufacturers are considering a return to solid end cans that require a separate can opener to open. Typically, these can openers include a handle, a lug for engaging the can seam and a pointed cutter for piercing the solid end of a metal can. This type of can opener is also known as a "church key".

In the past church key openers were made of a relatively thick gauge material suitable for opening steel cans. This made the can opener large and cumbersome and inconvenient for the consumer to use and carry. In addition, the pointed cutter of the church key opener makes the opener difficult to carry in a pocket or purse. A good place to carry this type of can opener is in a fishing tackle box but you can't fish all of the time. Moreover, the cutter is exposed at all times and is a potential source of injury to a consumer and to any items that come in contact with the cutter.

In view of the problems associated with tab openers and with using conventional can openers for metal beverage cans, there is a need in the art for an improved can opener for metal cans. Therefore, it is an object of the present invention to provide an improved can opener and an improved method for opening metal cans having a solid end.

It is yet another object of the present invention to provide an improved can opener for beverage cans formed with a cutter that can be extended and locked for piercing a solid can end and then folded and protected for transport and storage.

It is further object of the present invention to provide an improved can opener with a novel folding and locking mechanism for the cutter.

It is a still further object of the present invention to provide an improved can opener that is inexpensive to manufacture, lightweight, compact, easy to carry on a key chain, safe to use and effective for opening metal cans.

Other objects, advantages and capabilities of the present invention will become more apparent as the description proceeds.

SUMMARY OF THE INVENTION

In accordance with the invention, an improved can opener and an improved method for forming pourable openings in metal cans having a solid end are provided. The can opener, simply stated, includes: a handle; a cutter mounted to the handle; and a locking mechanism for pivotably mounting and locking the cutter. The handle includes a pair of eyelets for containing a hinge pin for pivotably mounting the cutter to the handle. The locking mechanism includes locking members in the form of mating pawls and indentations formed on the handle and cutter. The locking mechanism allows the cutter to be locked in an operating position for opening a can or in a storage position for storing the can opener with the cutter shielded by the handle.

The cutter includes a pointed tip for piercing the can to form a pourable opening and a folded lug for engaging a seam of the can to allow a fulcrum for the pointed tip to be pressed into the can. The cutter also includes an integrally formed barrel cam which is attached to the hinge pin. The barrel cam includes pairs of indentations adapted for mating engagement with a pair of pawls formed on the handle. One pair of indentations forms a detent for locking the cutter in the operating position and one pair of indentations forms a detent for locking the cutter in the storage position. The edges of indentations and the connecting edge of the barrel cam are formed with camming surfaces that permit the cutter to be rotated through an approximately 180° angle from the operating position to the storage position.

The handle is formed in a wishbone shape with a pair of flexible segments on which the pawls are mounted. The segments are adapted to flex and provide a camming motion for pressing the pawls into engagement with the camming surfaces and to releasably engage or disengage the indentations.

The cutter and handle are adapted for volume manufacture using conventional stamping and forming processes. Assembly of the can opener is facilitated by the simple three piece construction (i.e., handle, cutter, hinge pin). In an illustrative embodiment, assembly of the can opener can be effected by placing the hinge pin through an opening in the barrel cam and then attaching the hinge pin to the barrel cam. The hinge pin can be formed as a solid pin that is attached to the barrel cam by swaging the barrel cam or as a roll pin that expands against the opening in the barrel cam. In either case during rotation of the cutter from the operating position to the storage position, the hinge pin and cutter rotate together. At the same time the eyelets and pawls of the handle move outwardly with a spring force provided by the wishbone segments.

In an alternate embodiment, the cutter and handle are extruded into blanks and then machined to a final configuration. In this embodiment separate locking pins take the place of the pawls previously described. The locking pins are retained in pockets formed on the cutter and are adapted for mating engagement with pairs of indentations formed on the handle.

The method of the invention is adapted to form a pourable opening in a can and broadly stated, includes the steps of: providing a can having a circumferential seam and a can end; providing a can opener including a handle, a cutter pivotably mounted to the handle, and a lug formed on the cutter with the cutter adapted to lock in an operating position or a storage position in which a tip of the cutter is protected; placing the lug in contact with a seam of the can with the cutter in the operating position; manipulating the handle to pierce the can end and form the pourable opening; and then folding the cutter towards the handle into the storage position.

DETAILED DESCRIPTION OF THE PREFERRED EMBODIMENT

Figure 1:
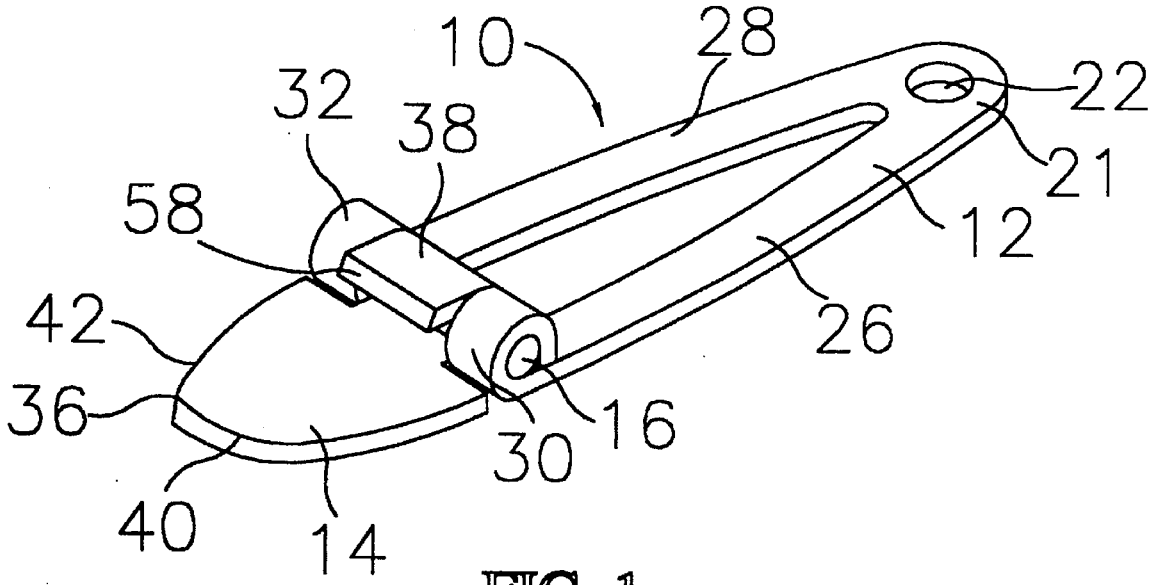
FIG. 1 is a perspective view of a can opener constructed in accordance with the invention.
Figure 3:
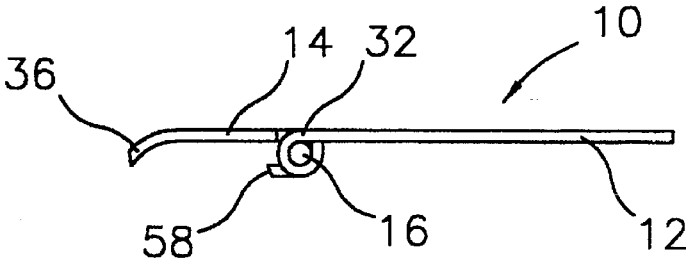
FIG. 3 is a side elevation view of FIG. 2.
Figure 4:
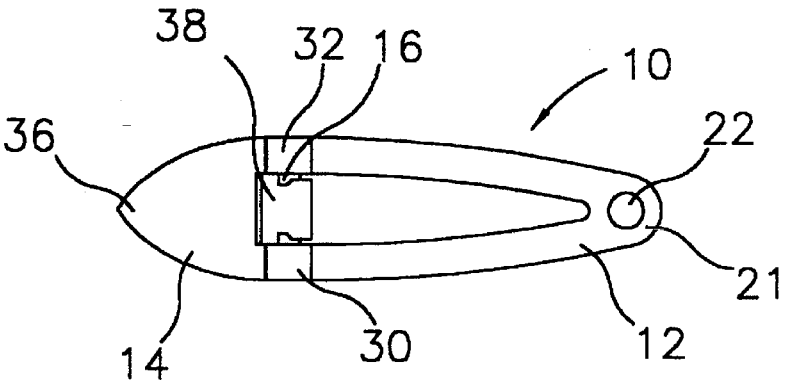
FIG. 4 is a bottom view of FIG. 2.

Referring now to FIG. 1, a can opener 10 constructed in accordance with the invention is shown. The can opener 10 includes a handle 12; a cutter 14 pivotably mounted to the handle 12; and a hinge pin 16 for mounting the cutter 14 to the handle 12. The can opener 10 is adapted for use in the operating position shown in FIGS. 2–4 in which the cutter is extended or in the storage position shown in FIGS. 5–7 in which the cutter 14 is folded towards the handle 12 and protected by the handle.

Figure 8A:
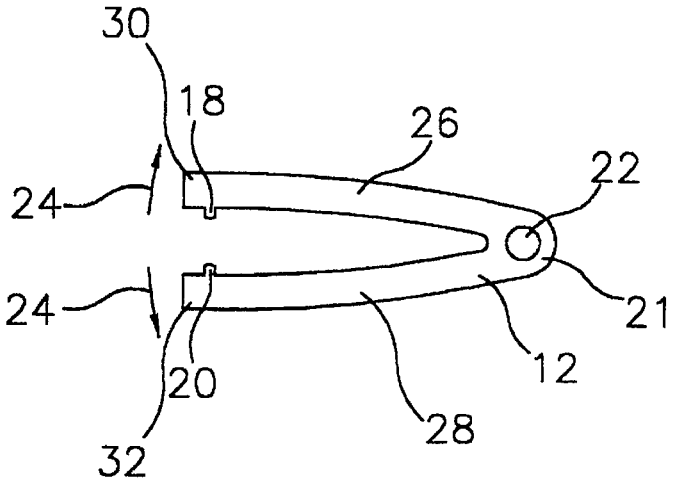
FIG. 8A is a plan view of the handle for the can opener shown in FIG. 1.
Figure 8B:
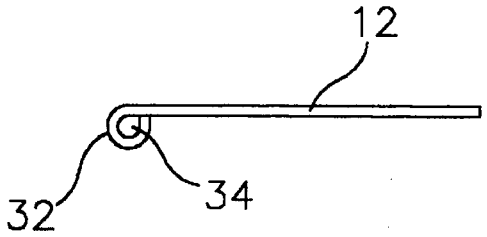
FIG. 8B is a side elevation view of FIG. 8A.
Figure 8C:
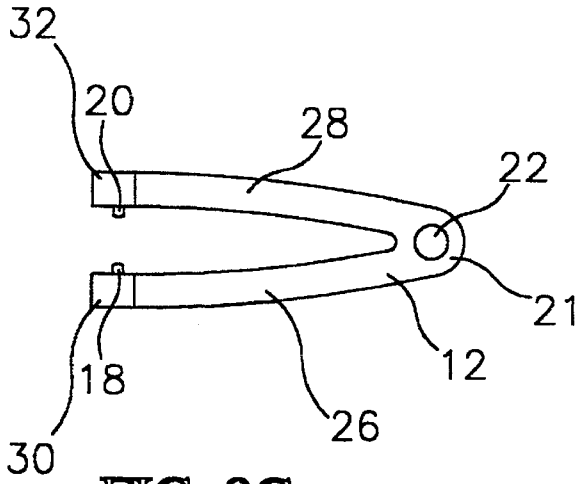
FIG. 8C is a bottom view of FIG. 8A.

As shown in FIGS. 8A–8C, the handle 12 is generally wishboned shaped, or bifurcated, and includes a pair of flexible wishbone segments 26, 28 each having a pawl 18, 20. The pawls 18, 20 are generally rectangular in shape and are preferably formed integrally with the handle 12. The wishbone shape of the handle 12 allows the wishbone segments 26, 28 and the pawls 18, 20 to pivot outwardly during use, as indicated by the flexure arrows 24 in FIG. 8A. As will be further explained, this flexure permits the pawls 18, 20 to function as locking members and also to move in a camming motion. The flexible wishbone segments 26, 28 provide the spring force necessary to initiate the camming motion in the pawls 18, 20.

The handle 12 also includes a connecting portion 21 wherein a through opening 22 is formed. The connecting portion 21 is sized with an area and thickness that allows the flexible segments 26, 28 and pawls 18, 20 to flex as indicated by the flexure arrows 24. The through opening 22 in the connecting portion 21 of the handle 12 allows the can opener 10 to be attached to a key chain, strap, clip or other member for convenient transport and storage.

The handle 12 also includes eyelets 30, 32 formed at the end of each flexible wishbone segment 26, 28 for containing the pivot pin 16. As shown in FIG. 8B, the eyelets 30, 32 are shaped by bending to form through openings 34 for containing the hinge pin 16 (FIG. 1). The hinge pin 16 is attached to the cutter 14 and moves freely within the eyelets 30, 32. This allows the eyelets 30, 32 to flex with the wishbone segments 26, 28 of the handle 12.

As also shown in FIG. 8B, the handle 12 is formed of a thin sheet of material such as aluminum, brass, bronze, steel or stainless steel. A preferred material for the handle 12 is high tensile 301 cold rolled stainless steel, ¼ or ½ hard. The material selected for the handle 12 must possess a modulus of elasticity and yield strength sufficient to resist high stresses developed in the connecting portion 21 and flexible members 26,28 of the handle 12 as well as bending stress caused by the piercing action. The handle 12 can be stamped in the desired shape and then shaped by bending to form the eyelets 30, 32. In addition, indicia such as a trademark and manufacturer can be imprinted or stamped on the handle 12.

Figure 9A:
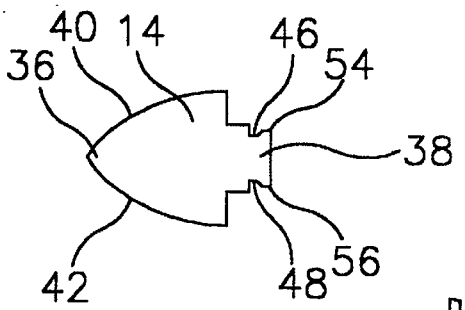
FIG. 9A is a plan view of the cutter for the can opener shown in FIG. 1.
Figure 9F:
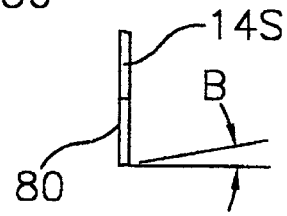
FIG. 9F is a front elevation view of FIG. 9D.
Figure 9D:
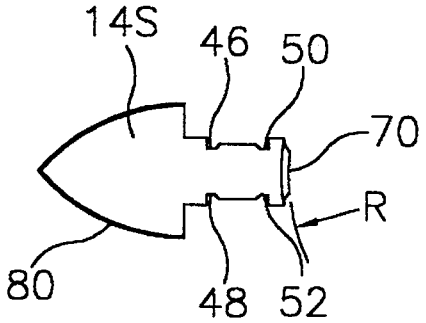
FIG. 9D is a plan view of a stamped blank for forming the cutter shown in FIGS. 9A–9C.
Figure 9E:
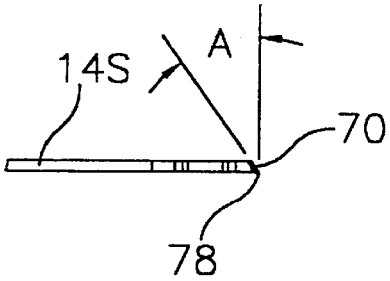
FIG. 9E is a side elevation view of FIG. 9D.
Figure 9B:
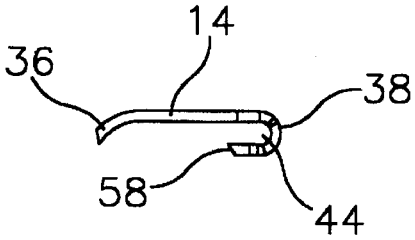
FIG. 9B is a side elevation view of FIG. 9A.
Figure 9G:
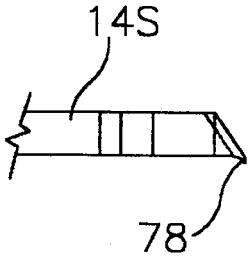
FIG. 9G is an enlarged view of a portion of FIG. 9E.
Figure 9C:
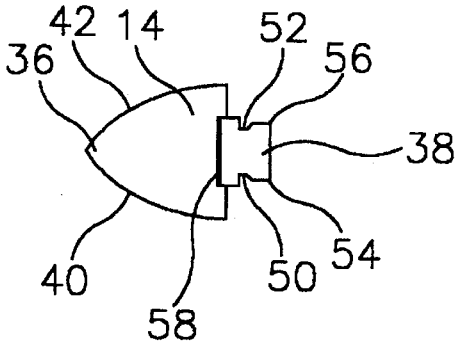
FIG. 9C is a bottom view of FIG. 9A.

Referring now to FIGS. 9A–9C, the cutter 14 is shown separately. The cutter 14 viewed from above has a generally triangular shaped peripheral configuration. The cutter 14 includes a pointed tip 36 and an integrally formed barrel cam 38. As shown in FIG. 9B, the pointed tip 36 is bent downward with a radius of curvature to facilitate piercing the solid can end 62 of a can 60 (FIG. 13A and 13B) and to better guard the point in the stored position. In addition, peripheral edges 40, 42 of the pointed tip 36 can be formed as sharp orthogonal edges to facilitate piercing the can end 62 (FIGS. 13A and 13B) to form a pourable opening 68 in the can end 62.

Figure 10A:
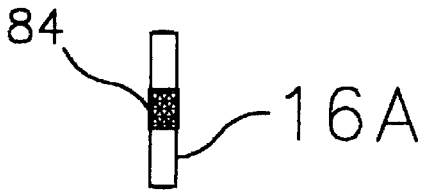
FIG. 10A is a plan view of a hinge pin for can opener formed as a solid pin.
Figure 10B:
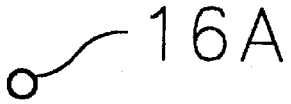
FIG. 10B is a side elevation view of FIG. 10A.
Figure 11A:
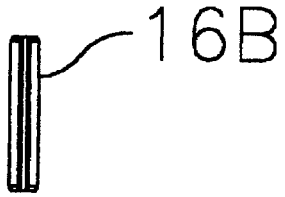
FIG. 11A is a plan view of a hinge pin for the can opener formed as a roll pin.
Figure 11B:
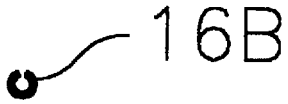
FIG. 11B is a side elevation view of FIG. 11A.

As shown in FIG. 9B, the barrel cam 38 is shaped with an approximately 180° bend formed along a predetermined bending radius. This forms an opening 44 for the hinge pin 16 (FIG. 1) and a lug 58 on a terminating edge for engaging a seam 66 (FIG. 13B) of the can 60 during operation of the can opener 10. For a solid hinge pin 16A (FIG. 10A), the barrel cam 38 is crimped or swaged during assembly to secure the hinge pin 16A to the cutter 14. In order to facilitate the connection between the solid hinge pin 16A and barrel cam 38 the solid hinge pin 16A can be formed with a knurled surface 84. For a roll pin hinge pin 16B (FIG. 11A), the hinge pin 16B expands within the opening 44 of the barrel cam 38 to secure the hinge pin 16B to the cutter 14. The opening 44 is slightly larger than the space between the cutter 14 and the lug 58 to retain the cutter 14 and hinge pin 16B.

Figure 5:
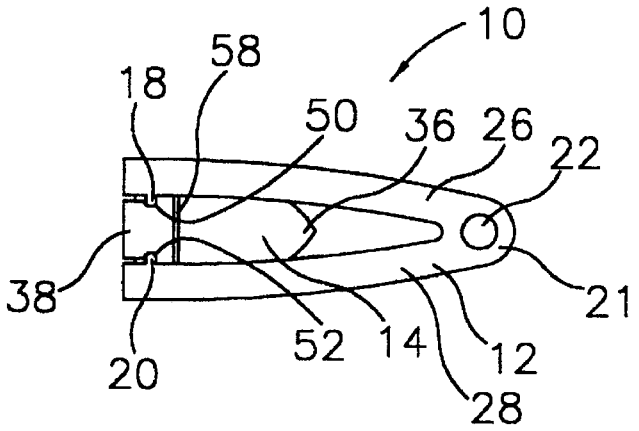
FIG. 5 is a plan view of the can opener shown in the storage position with the cutter folded towards the handle.
Figure 6:
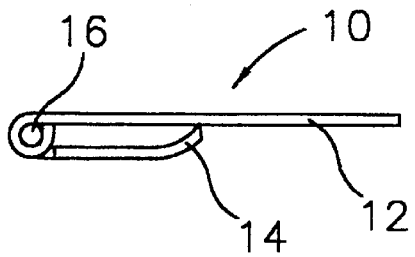
FIG. 6 is a side elevation view of FIG. 5.
Figure 7:
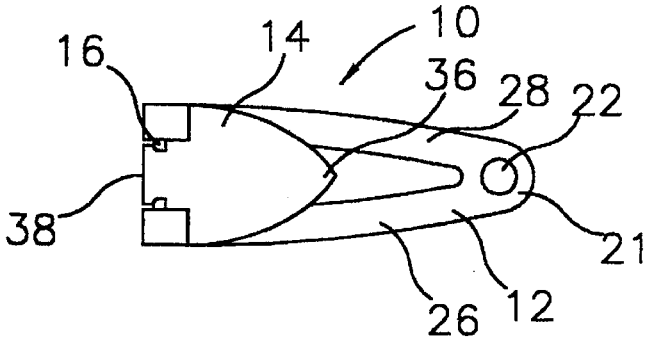
FIG. 7 is a bottom view of FIG. 5.

The barrel cam 38 is formed with a width that allows it to fit between the flexible wishbone segments 26, 28 of the handle 12. In addition, the barrel cam 38 includes a pair of indentations 46, 48 (FIG. 9A) for locking the cutter 14 in an operating position (FIGS. 2–4), and a pair of indentations 50, 52 (FIG. 9C) for locking the cutter 14 in a storage position (FIG. 5–7).

The indentations 46, 48, 50, 52 are formed with camming surfaces that are adapted for mating engagement with the pawls 18, 20 formed on the handle 12. Specifically, a camming surface 54 is formed by the edges of the indentations 46 and 50 and the connecting edge of the barrel cam 38 therebetween. In a similar manner a camming surface 56 is formed by the edges of the indentations 48 and 52 and the connecting edge of the barrel cam 38 therebetween.

The barrel cam 38 and pairs of indentations 46, 48 and 50, 52 are shaped and dimensioned such that the pawls 18, 20 will fit within the indentations and press against a vertical edge of the indentations for locking the cutter 14 in the operating or storage positions. However, the indentations 46, 48 or 50, 52 also include the tapered camming surfaces 54, 56 (FIG. 9A) formed continuously with the edges of the barrel cam 38 that permit movement of the cutter tip 14 between the operating and storage positions.

Figure 12:
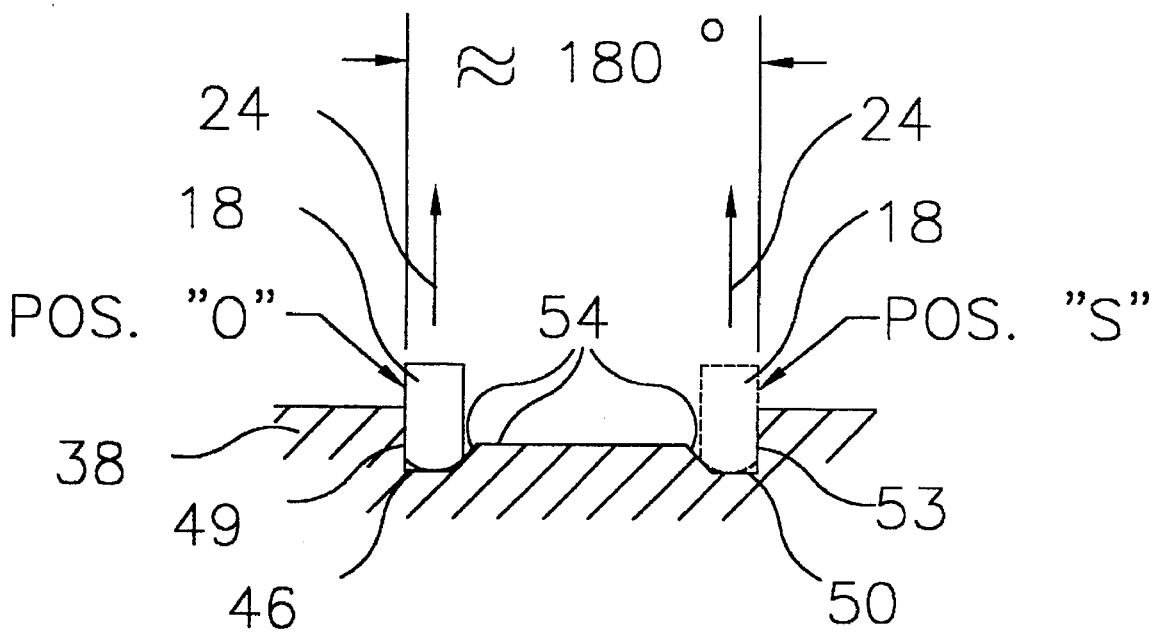
FIG. 12 is an enlarged schematic view of a portion of the cutter showing the operation of camming surfaces.

A camming surface is shown schematically in FIG. 12. In FIG. 12, camming surface 54 is formed between indentations 46 and 50. The pawl 18 is adapted to engage either indentation 46 or 50 depending on the rotational position of the cutter 14 and barrel cam 38. In the operating position of the cutter (position "O"), the pawl 18 engages indentation 46. In position "O", the vertical edge 49 of the indentation 46 locks the cutter 14 in the operating position by preventing further angular rotation of the cutter 14. However, upon rotation of the cutter 14 by the user to the storage position, the pawl 18 is free to move along camming surface 54 and into indentation 50. This is the storage position (position "S") and corresponds to an approximately 180° angular rotation of the cutter 14 from the operating position. In position "S", the vertical edge 53 of the indentation 50 locks the cutter 14 in the storage position by preventing further angular rotation of the cutter 14. The camming motion of the pawl 18 during rotation of the cutter 14 between these positions is represented by flexure arrows 24.

Figure 2:
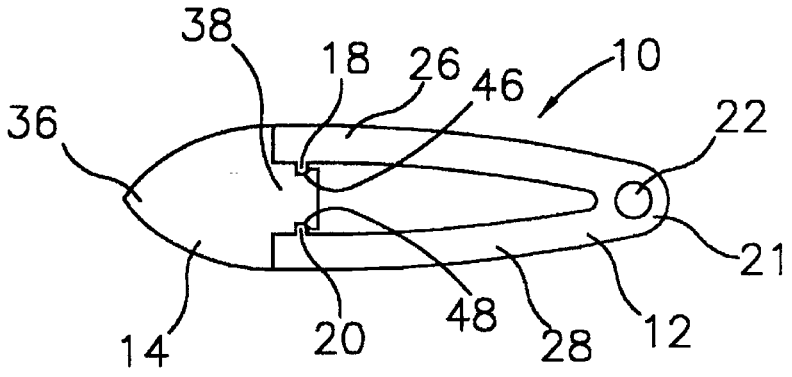
FIG. 2 is a plan view of the can opener shown in an operating position with cutter extended for opening a can.

Thus as clearly shown in FIG. 2, the indentations 46, 48 are shaped to lock the cutter tip 14 in the operating position and resist upward movement of the cutter tip 14 during use but to allow movement of the cutter tip 14 for folding the cutter tip 14 into the protected storage position. In a similar manner, and as clearly shown in FIG. 5, the indentations 50, 52 are shaped to lock the cutter tip 14 in the storage position and resist further folding of the cutter tip 14 but to allow movement of the cutter tip 14 to the operating position.

The cutter 14 can be formed of the same materials as the handle 12 such as aluminum, brass, bronze, steel or stainless steel. One method for forming the cutter 14, is by stamping a blank and then bending the blank to the final shape. A stamped cutter blank 14S is shown in FIG. 9D, 9E, 9F and 9G. As clearly shown in FIG. 9F the edge 80 of the cutter blank 14S is sharpened at an angle of "B". The angle B is preferably from about 0° to 15°. This sharpened edge 80 permits the cutter 14 to more easily pierce the solid can end 62 (FIG. 13A) during operation of the can opener 10.

As clearly shown in FIG. 9E, the stamped cutter blank 14S also includes a sharpened edge 70 which will form the terminating edge for the lug 58 (FIG. 9B) in the completed cutter 14. This edge 70 is preferably formed with an angle "A" of at least 35° and preferably with an angle from 35° to 45° to prevent interference with the neck of the can body 64 (FIG. 13B) during operation of the can opener 10. In addition, as clearly shown in FIG. 9D the edge 70 can be shaped with a radius of "R" that matches or is slightly larger that a radius of the can seam 66 (FIG. 13B).

As also clearly shown in FIG. 9D, the stamped cutter blank 14S is includes indentations 46, 48, 50, 52 having camming surfaces that function in the previously described manner. In addition, as clearly shown in FIG. 9G the edge 78 of the stamped cutter blank 14S can be staked or coined to better engage the can seam 66. Following stamping, the cutter blank 14S can be shaped by bending to form the downturned tip 36 (FIG. 9B) and the barrel cam 38 (FIG. 9B). As previously explained, the barrel cam 38 is bent through an angle of approximately 180° to form an opening 44 (FIG. 9B) for the hinge pin 16 and the lug 58 for engaging the seam 66 (FIG. 13B) of the can 64.

During assembly of the can opener 10, the cutter 14 is pivotably attached to handle 12 by placing the hinge pin 16 through the eyelets 30, 32 and through the opening 44 (FIG. 9B) in the barrel cam 38. The hinge pin 16 is then attached to the cutter 14 by securing the hinge pin 16 to the barrel cam 38. As previously described, the solid hinge pin 16A requires a swaging step for securing the hinge pin 16A to the barrel cam 38. The roll pin 16B functions by expanding within the barrel cam 38.

Operation

Figure 13A:
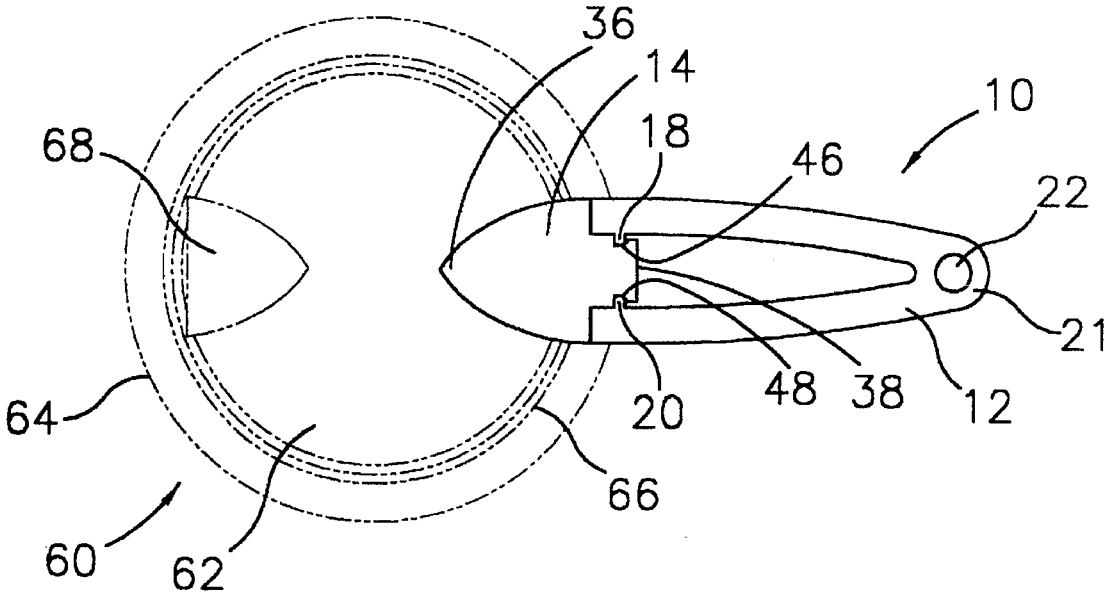
FIG. 13A is a plan view of the opener shown in use opening a can with the can shown in phantom lines.
Figure 13B:
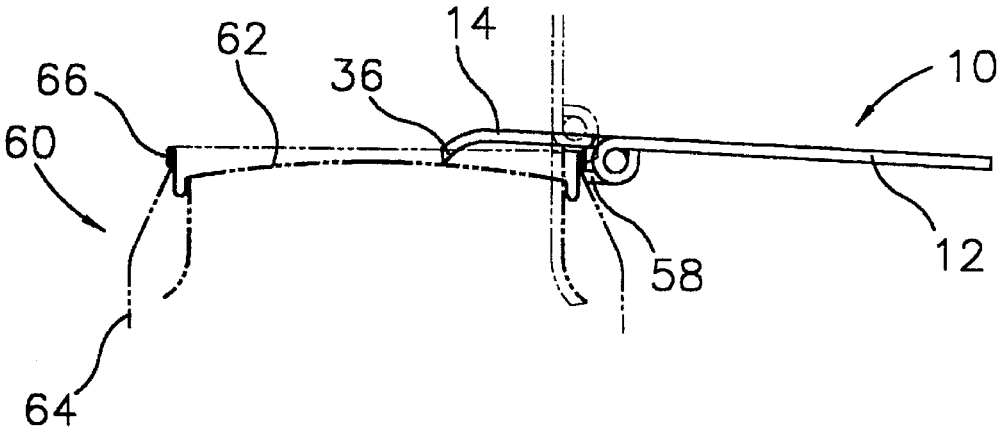
FIG. 13B is a side elevation view of FIG. 13A.

Referring now to FIGS. 13A and 13B, the can opener 10 is shown in use for opening the metal can 60. The metal can 60 includes a solid can end 62 attached to a can body 64 by means of the peripheral seam 66. In the operating position of the can opener 10, the pawls 18, 20 on the handle 12 engage the indentations 46, 48 formed in the barrel cam 38 for the cutter 14. As previously described, the shape of the indentations 46, 48 lock the cutter 14 and resist upward movement of the cutter 14 as it is pushed into the can end 62.

As clearly shown in FIG. 13B, during use of the can opener 10, the lug 58 is hooked under the seam 66 of the can 60 and the handle 12 is manipulated by the user from the generally horizontal position shown by solid lines to the generally vertical position by the phantom lines. This causes the cutter 14 to pierce the can end 62 and form an opening 68 (FIG. 13A). The opening 68 is generally triangular shaped and allows a liquid beverage to be dispensed from the can 60. As shown, two openings 68 can be formed to permit air flow into the can during pouring.

Alternate Embodiments

FIGS. 14A–14C and FIG. 14D illustrate a cutter 14E formed by an extrusion process. The extruded cutter 14E is equivalent in operation to the cutter 14 previously described but is formed by extruding a blank 14EB (FIG. 14D) out of a material such as aluminum and then machining the blank 14EB into the desired shape. As clearly shown in FIG. 14D, the extruded blank 14EB includes an extruded point 36E, an extruded lug 58E and an extruded barrel cam 38E. Following machining to the configurations shown in FIGS. 14A–14C these components function substantially the same as the equivalent components previously described. In addition, as clearly shown in FIG. 14A the extruded cutter 14E includes a pair of pockets 82 sized to loosely retain locking pins 76. Preferably the pockets 82 are formed as circular holes that do not pass completely through the full thickness of the cutter 14E. In the extruded embodiment the locking pins 76 fit between the extruded cutter 14E and the extruded handle 12E (FIG. 15A) and function as locking members in place of the pawls 18, 20 (FIG. 8A) previously described.

Figure 14A:
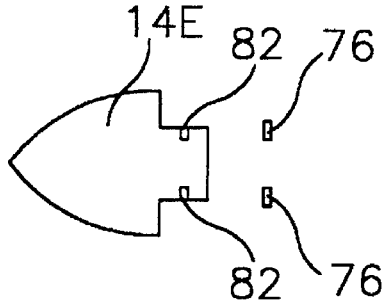
FIG. 14A is a plan view of an alternate embodiment cutter formed using an extrusion process.
Figure 14B:
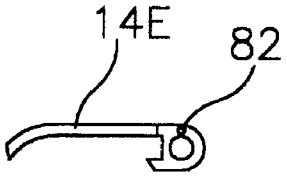
FIG. 14B is a side elevation view of FIG. 14A.
Figure 14C:
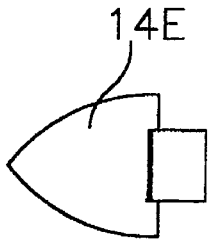
FIG. 14C is a bottom view of FIG. 14A.
Figure 14D:
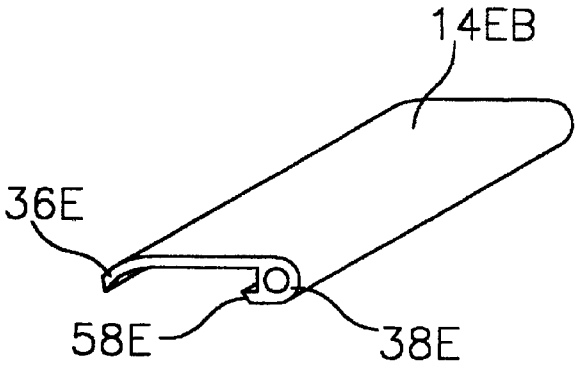
FIG. 14D is a perspective view of an extruded blank for forming the cutter shown in FIG. 14A.
Figure 15A:
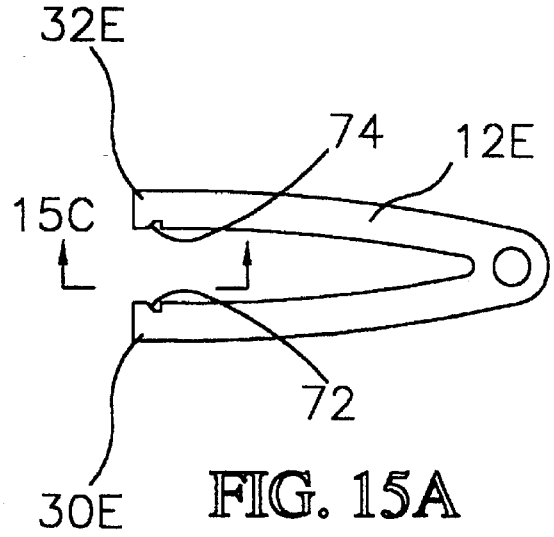
FIG. 15A is a plan view of an alternate embodiment handle formed using an extrusion process.
Figure 15C:
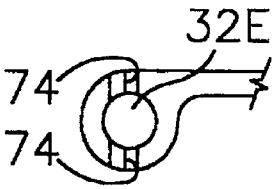
FIG. 15C is an enlarged side elevation view taken along line 15C of FIG. 15A.
Figure 15B:
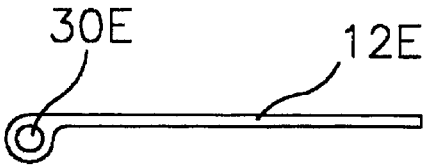
FIG. 15B is a side elevation view of FIG. 15A.
Figure 15D:
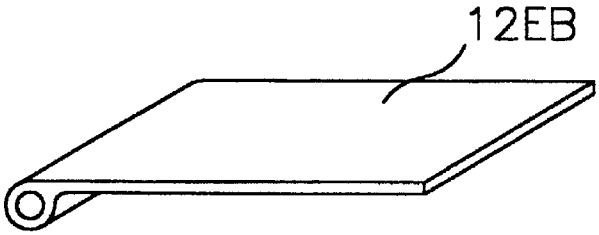
FIG. 15D is a perspective view of an extruded blank for the handle shown in FIG. 15A.

With reference to FIGS. 15A–15C and 15D, the extruded handle 12E is shown. The extruded handle 12E is adapted for assembly with the extruded cutter 14E. An extruded handle blank 12EB is formed substantially in the shape shown in FIG. 15D. A machining process is then used to shape the handle 12E with a wishbone shape and with eyelets 30E, 32E as previously described. In this embodiment, the handle 12E includes a pair of indentations 72 formed on one side thereof and a pair of indentations 74 formed on an opposite side. In the assembled can opener, these pairs of indentations 72 and 74 are adapted for mating engagement with the locking pins 76 (FIG. 14A). During assembly of the extruded handle 12E with the extruded cutter 14E, the locking pins 76 are retained within the pockets 82 (FIG. 14A) on the extruded cutter 14E (FIG. 14A) to form locking members equivalent to the pawls 18, 20 (FIG. 8A) previously described. A roll pin hinge pin 16B (FIG. 11A) as previously described can be used to pivotably attach the extruded cutter 14E to the extruded handle 12E.

Thus the invention provides a folding safety can opener and a method for opening cans. While the invention has been described with reference to certain preferred embodiments, as will be apparent to those skilled in the art, certain changes and modifications can be made without departing from the scope of the invention as defined by the following claims.

What is claimed is:

1. A can opener comprising:

a handle formed with a wishbone shape including a flexible segment with a pawl formed thereon;

a cutter pivotably mounted to the handle said cutter comprising a tip for penetrating an end of a can and a lug for engaging a seam of the can to allow a user to press the tip into the can end to form an opening, said cutter further comprising a surface shaped to move the pawl upon rotation of the cutter by the user; and an indentation formed in the surface, said indentation formed with a first edge shaded to receive the pawl upon rotation of the cutter in a first direction and a second edge shaped to prevent rotation of the cutter in a second direction and to lock the cutter in a first position.

2. The can opener as claimed in claim 1 and further comprising a second indentation formed in the surface shaped to releasably engage the pawl to lock the cutter in a second position.

3. A can opener comprising:

a handle formed in a wishbone shape comprising a pair of flexible segments and a connecting portion;

a cutter pivotably mounted to the handle and having a tip for penetrating an end of a can and a lug for engaging a seam of the can to allow a user to press the tip into the end to form an opening; and a locking mechanism comprising a pawl formed on one of the flexible segments and first and second indentations formed on a surface of the handle, said pawl and indentations shaped and dimensioned to lock the cutter in an operating position and to lock the cutter in a storage position with the cutter tip shielded by the handle.

4. The can opener as recited in claim 3 and wherein the handle includes a second pawl formed on one of the flexible segments.

5. The can opener as recited in claim 4 and wherein the cutter includes a third and a fourth indentation shaped to releasably engage and disengage the second pawl.

6. The can opener as recited in claim 5 and wherein the surface of the handle comprises a camming surface.

7. The can opener as recited in claim 3 and wherein the surface comprises a barrel cam comprising a formed portion of the cutter.

8. A can opener comprising:

a handle formed in a wishbone shape with a flexible segment;

a cutter pivotably mounted to the handle and having a tip for penetrating an end of a can;

a lug formed on the cutter for engaging a seam of the can to allow a user to pivot the pointed tip into an end to form an opening;

a camming surface formed on the cutter;

a locking mechanism including a pawl formed on the flexible segment and first and second indentations formed on the camming surface, said pawl and indentation shaped and dimensioned to lock the cutter in a first position and to lock the cutter in a second position.

9. The can opener as recited in claim 8 and wherein the first position is an operating position for opening the can and the second position is a storage position for shielding the cutter.

10. The can opener as recited in claim 8 and wherein the indentations and camming surface comprise a barrel cam formed as a portion of the cutter.

11. The can opener as recited in claim 10 and wherein the barrel cam includes an opening for a pivot pin and a formed edge that forms the lug.

12. The can opener as recited in claim 11 and wherein the handle includes a pair of pawls and the barrel cam includes a first pair of indentations for locking the cutter in the first position and a second pair of indentations for locking the cutter in the second position.

13. A can opener for forming an opening in a can, said can opener comprising:

a handle formed in a wishbone shape with a connecting portion and two flexible segments;

a cutter pivotably mounted to the handle, said cutter including a tip for penetrating the can and a lug formed to engage a seam of the can to allow a user to pivot the tip into the can;

a camming surface formed on the cutter;

a pawl formed on one of the flexible segments of the handle in contact with the camming surface for movement therewith;

a first indentation formed on the cutter shaped to receive the pawl and including a first edge shaped to engage the pawl and prevent rotation of the cutter in a first direction to lock the handle in an operating position;

a second indentation formed on the cutter shaped to receive the pawl and including a second edge shaded to engage the pawl and prevent rotation of the cutter in a second direction to lock the handle in a storage position.

14. The can opener as recited in claim 13 and wherein the handle comprises metal and the connecting portion of the handle includes a through opening.

15. The can opener as recited in claim 13 and wherein a formed portion of the cutter is dimensioned to fit between the flexible segments and forms the camming surface.

16. The can opener as recited in claim 13 and wherein each flexible segment includes an eyelet for mounting a pivot pin for pivotably mounting the cutter.

17. The can opener as recited in claim 16 and wherein the pivot pin comprises a solid pin attached to the cutter by swaging or a press fit.

18. The can opener as recited in claim 16 and wherein the pivot pin comprises a roll pin adapted to expand and contact an opening in the cutter.

19. The can opener as recited in claim 13 and wherein the cutter and the handle comprise a metal.

20. The can opener as recited in claim 13 and wherein the handle is formed of a material selected from the class consisting of aluminum, brass, bronze, steel and stainless steel.

21. The can opener as recited in claim 13 and wherein a tip of the lug is formed with a radius that corresponds to a radius of an end of the can.

22. The can opener as claimed in claim 13 and wherein the lug is formed at an angle of at least 35° to prevent interference with a neck portion of an end of the can.

23. A can opener comprising:

a handle comprising a wishbone shade including a pair of flexible segments and a connecting portion, said handle further comprising first and second indentations formed on a surface of one of the flexible segments;

a cutter pivotably mounted to the handle said cutter comprising a tip for penetrating an end of a can and a lug for engaging a seam of the can to allow a user to press the tip into the can end to form a pourable opening; and a pawl formed on the cutter shaped and dimensioned to press against the surface and to fit into the first indentation upon rotation of the cutter in a first direction to lock the cutter in a first position and to fit into the second indentation upon rotation of the cutter in a second direction to lock the cutter in a second position.

24. The can opener as claimed in claim 23 and wherein the pawl comprises a pin attached to the cutter.

25. The can opener as claimed in claim 23 and wherein the handle is formed in a wish bone shade and each flexible segment includes a pair of indentations.

26. The can opener as claimed in claim 23 and wherein the first indentation includes a first edge shaped to engage the pawl to prevent rotation of the cutter in the first direction and the second indentation includes a second edge shaped to engage the pawl and prevent rotation of the cutter in the second direction.

27. A can opener comprising:

a handle comprising a pair of flexible segments and a connecting portion, said handle further comprising a first indentation and a second indentation formed on a surface thereof;

a cutter pivotably mounted to the handle said cutter comprising a tip for penetrating an end of a can and a lug for engaging a seam of the can to allow a user to press the tip into the end to form an opening, said cutter further comprising a camming surface;

a pin mounted in a pocket on the cutter, said pin movable by the camming surface to engage a first edge of the first indentation to prevent rotation of the cutter in a first direction and to engage a second edge of the second indentation to prevent rotation of the cutter in a second direction.

* * * * *